US005377577A

United States Patent [19]

Bounkong et al.

[11] Patent Number: 5,377,577

[45] Date of Patent: Jan. 3, 1995

[54] BALLISTIC SHIELD

[75] Inventors: Bouakeo Bounkong, Chantilly; Joseph F. Fernandez, Vienna; Oliver L. North, Bluemont, all of Va.

[73] Assignee: Guardian Technologies International, Sterling, Va.

[21] Appl. No.: 977,015

[22] Filed: Nov. 16, 1992

[51] Int. Cl.[6] ..... F41H 5/08; F41H 7/00

[52] U.S. Cl. ..... 89/36.05; 89/36.07; 2/2.5

[58] Field of Search ..... 2/2.5, 2, 1, DIG. 6; 89/36.01, 36.02, 36.04, 36.05, 36.07

[56] References Cited

U.S. PATENT DOCUMENTS

| | | | |
|---|---|---|---|
| 377,732 | 2/1888 | Adams | 89/36.07 |
| 4,412,495 | 11/1983 | Sankar | 89/36.05 |
| 4,475,247 | 10/1984 | Lee | 2/2.5 |
| 4,697,362 | 10/1987 | Wasserman | 2/DIG. 6 |
| 4,774,724 | 10/1988 | Sacks | 2/2.5 |
| 4,782,735 | 11/1988 | Mui et al. | 89/36.05 |
| 4,843,947 | 7/1989 | Bauer et al. | 89/36.05 |
| 5,073,985 | 12/1991 | Stone et al. | 2/2.5 |

*Primary Examiner*—Clifford D. Crowder
*Assistant Examiner*—Gloria Hale
*Attorney, Agent, or Firm*—John J. Byrne

[57] ABSTRACT

A ballistic-resistant blanket comprised of a plurality of panels that have inter-engaging connection means along their peripheries so that the individual panels can be arranged in a variety of shapes and forms and these panels are equipped with a plurality of handles to enable the users to handle the panels under a wide range of circumstances.

15 Claims, 3 Drawing Sheets

BALLISTIC SHIELD

BACKGROUND OF THE INVENTION

Bullet-resistant garments of various types have been known for many years. This invention uses some of the advancements in the bullet resistance garment art to provide a flexible protective shield which can be used in multiples so as to provide law enforcement officials with a movable shield of a size necessary to accomplish the missions undertaken.

FIELD OF INVENTION

This invention is primarily related to a shield for use by law enforcement or military personnel who oftentimes encounter threats that require a ballistic-resistant shield that can be quickly assembled and re-assembled into various configurations depending upon the circumstances of the threat encountered.

SUMMARY OF INVENTION

The principal objective of this invention is to provide a plurality of panels each of which is sufficiently light for one person to handle, flexible and equipped with inter-engaging connection means so that the individual panels can be quickly assembled and reassembled to desired configurations.

Generally, the invention provides a ballistic-resistant blanket formed by joining multiple and rectangular panels into a composite blanket the size of a configuration on site.

A still further objective of this invention is to provide a panel having an outer shell or carrier cover that snugly receives a ballistic penetration-resistant component to withstand the threat level likely to be encountered by the user.

Another important objective is to provide each panel with a plurality of handles on the different sides thereof so that individual panels can be used alone or in combination with one another.

A further objective of this invention is to provide a generally planar ballistic-resistant material which is foldable upon itself with means to secure the folds in position so that the folded panel can be used as a hand or arm carried shield.

Another objective of the invention is to provide an explosive damping blanket that can be used to prevent injury/damage by absorbing/containing fragments of a grenade or other small explosive device over which the blanket is thrown.

These and other objectives of the invention will become more apparent when one reads the following specification viewed in light of the drawings.

DESCRIPTION OF THE PREFERRED EMBODIMENT

Figure 3:
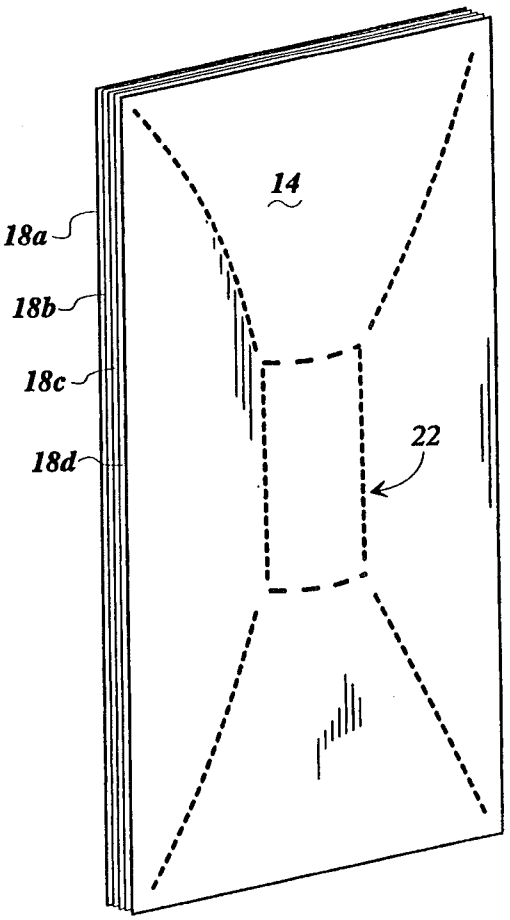
FIG. 3—is a perspective view of a ballistic-resistant insert.

Referring now to the drawings wherein like numerals indicate like parts, the numeral 10 indicates a ballistic-resistant panel of this invention. The panel's outer shell or envelope 12 is of heavy duty 500 denier Dupont Nylon. It is normally black but can also be in a plurality of camouflage designs. This fabric is sold by the Dupont Corporation under its trademark CORDURA. Within the pocket 13 of envelope 12 is a rectangular ballistic-resistant insert packet 14 made of plies of SPECTRA woven fabric and SPECTRA SHIELD. The inner surface of the shell 12 is coated with polyurethane and Teflon and with a water repellant coating on its outer surfaces;.

Figure 4:
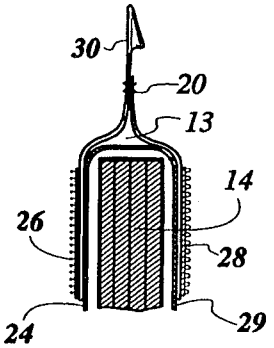
FIG. 4—is a cross-section along the line 4—4 of FIG. 2.

One of these ballistic insert packets, 14, is shown in perspective in FIG. 3. In many environments, the insert 14 is comprised of three or four ballistic packets such as 18*a*, 18*b*, 18*c*, etc. As seen in FIG. 4, the two outer packets, 18*a* and 18*d* are individually comprised of ten plies of woven material (SPECTRA woven fabric), which are described in more detail in Assignee's copending application Ser. No. 691,227 filed Apr. 25 1991, now U.S. Pat. No. 5,327,811 entitled Lightweight Ballistic Protective Device. SPECTRA is an ultra high molecular weight polyethylene based fiber sold by the Allied Fibers Division of Allied Signal, Inc. under this trademark. This fiber has an extraordinary strength to weight ratio and a low specific gravity. In addition to its high strength to weight ratio, SPECTRA fiber exhibits several outstanding properties such as moisture and chemical resistance. When woven into a fabric the product can be severed so that it can be configured into a wide variety of protective equipment.

Allied Signal markets its ballistic SPECTRA fiber in two formats: woven ballistic fabric known as SPECTRA and a non-woven SPECTRA SHIELD. The SPECTRA SHIELD product has two layers of fibers bonded with a resin at 0° to 90° orientation. The fibers and resin are packaged between upper and lower polyethylene film layers.

Sandwiched between the packages 18*a* and 18*d* are two packages 18*b* and 18*c* of SPECTRA SHIELD with each unit having ten plies. With that amount of ballistic-resistant material; that is, twenty plies of SPECTRA SHIELD sandwiched between two ten ply packages of SPECTRA woven fabric, a NIJ threat level IIA standard is met. The outer insert packets 18*a* and 18*d*, can be stitched together via 2" center, diamond pattern diagonal quilting 22 with SPECTRA 215 dn. thread. With these specifications, the approximate weight of the panel will be thirteen to fourteen pounds.

Figure 2:
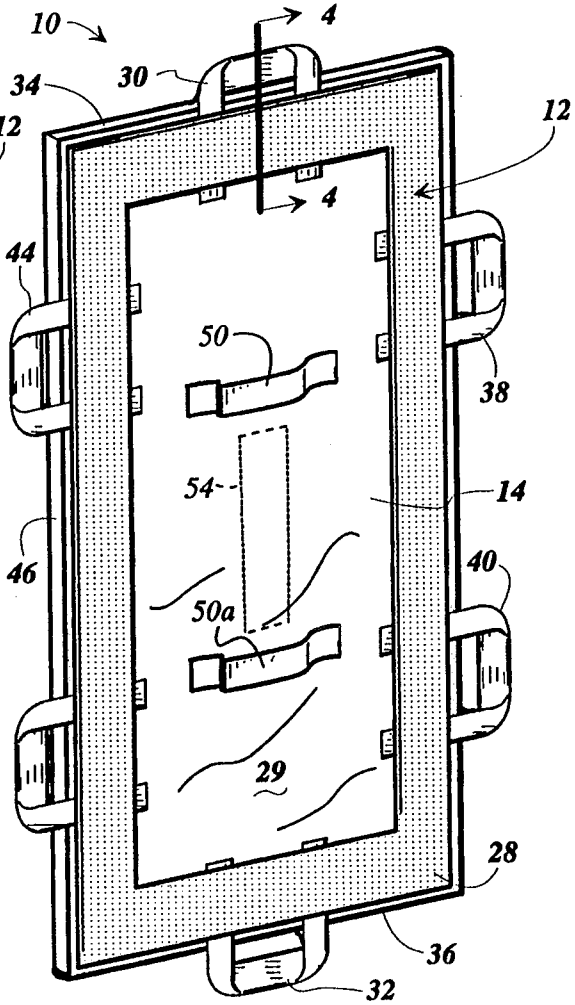
FIG. 2—is a perspective view of the panel of FIG. 1 showing the rear surface thereof.
Figure 1:
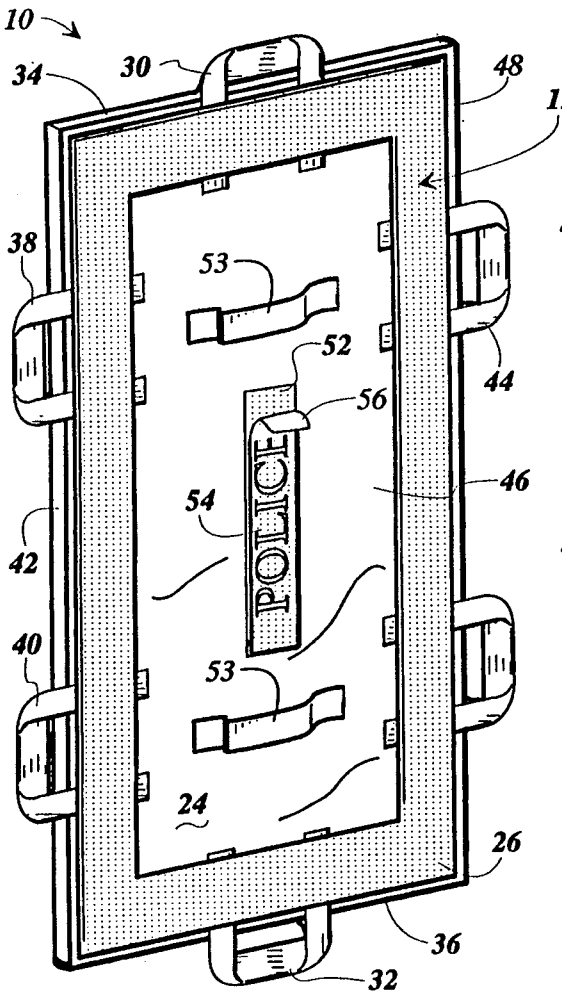
FIG. 1—is a perspective view of an individual panel showing the front surface thereof.

Referring now to FIG. 1, it can be seen that the front facing outer surface of 24 shell 12 has a border or peripheral border 26 of one element of a hook and loop fastening device. The border 26 is equipped with the loop elements of a VELCRO system and the opposite rear facing outer surface 29 (FIG. 2) of the panel has a border 28 equipped with the hook element of the VELCRO unit. The borders 26 and 28 of VELCRO are approximately four inches in width. A convenient and economical size for the envelope 12 is twenty-seven inches by fifty-four inches (27"×54"). The hook is on the side of the insignia 54 so that the users can quickly determine the front from the back side of the panel by feel and in conditions of low visibility.

The facing or panels 24 and 29 of the envelope 12 are joined, preferably by stitching 20, at their peripheries as seen best in FIG. 4. Along the stitched peripheries 20 panel 12 are a plurality of handles. Handles 30 and 32 are stitched to the envelope 12 at the lateral ends 34 and 36. Handles 38 and 40 are stitched to the envelope along the longitudinal side 42. Handles 44 and 46 are secured along the longitudinal side 48. Handle 50 is stitched to the side 29 of panel 12 toward the end 34 and a handle **50*a* is stitched to the panel 29 near end 36. Each of the handles 50 and 50*a* are approximately one third the length of the panel away from their respective ends. Similar handles 53 are secured to the side 24 as seen in FIG. 1. Stitched centrally of the outer planar surface 24 is a VELCRO segment 52 with the loop portion of a hook and loop fastening system. An insignia tab 54 has the hook portion of the fastening system on its interior surface 56 and a message such as "police" can be printed on the outer surface. Thereof, the tab 54 could also read FBI, Sheriff, or whatever name or message is appropriate. Although not shown, a similar tab is oftentimes secured to side 29 at the same location as shown for insignia tab 54**.

The handles 30,32,38,40,44 and 46 are made of the same fabric as 12 and are stitched to the envelope as shown in FIG. 4. Note that the handles are sewn to the envelope prior to securing the VELCRO elements.

Figure 5:
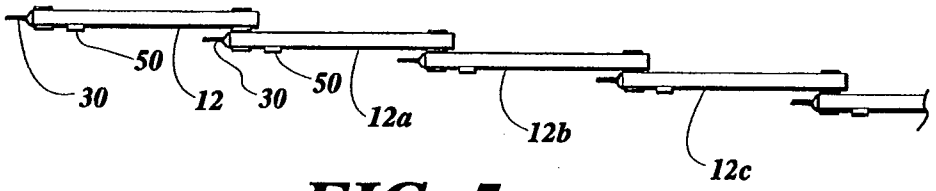
FIG. 5—is a top plan view of a series of panels connected in series to form an elongated shield.

FIG. 5 is a plan diagrammatic view of an assembly of panels 12, **12*a*, 12*b*, etc. Such an assembly can also be seen in FIG. 6. The assembly provides a series of panels secured along their longitudinal edges. The panels are easily gripped by the handles along the longitudinal edges of each panel or the handles of adjacent panels. It should be understood that the panels can also be connected along their longitudinal edges if a composite blanket having a greater height is desired. Such an arrangement is seen in FIG. 7. This is accomplished by securing the loop elements of border 26 with the hook elements of border 28** of an adjacent panel.

Figure 6:
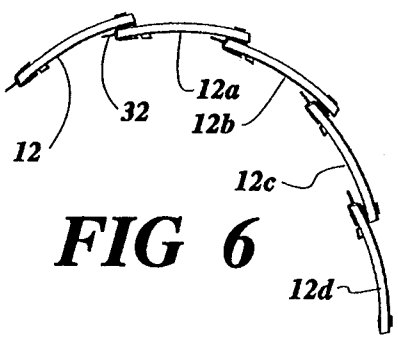
FIG. 6—is a plan view of the FIG. 3 assembly with the units arched to provide 180 degrees protection to its users.
Figure 7:
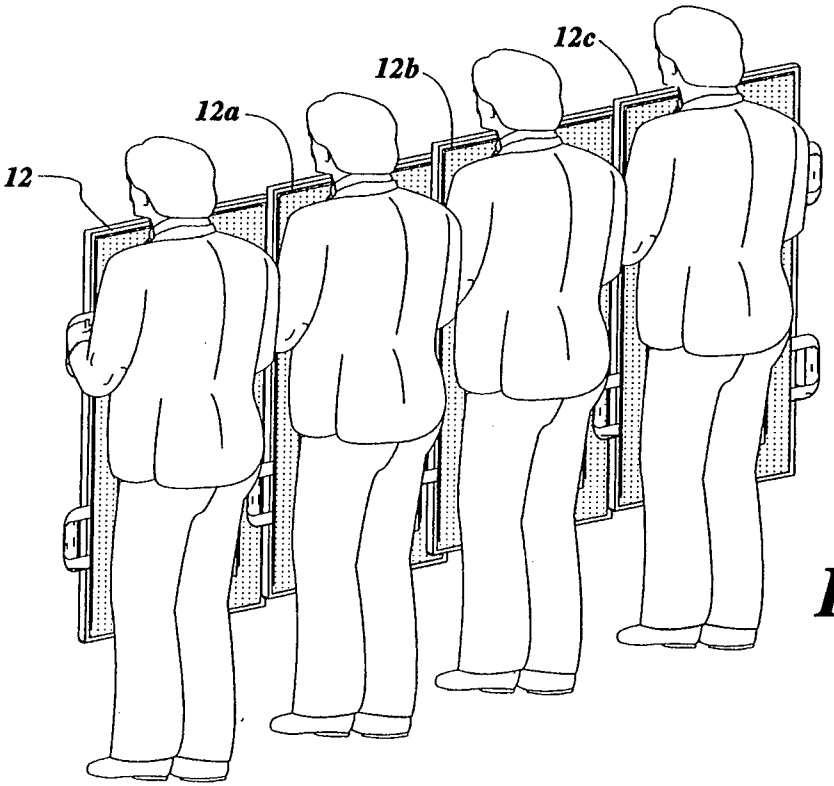
FIG. 7—is a perspective view showing several users behind a plurality of panels for protection as they retreat or advance from a threat.

FIG. 6 shows a series of units formed in a semi-circular pattern by the users so as to provide 180 degrees of protection. In some circumstances a circle can be formed to provide 360 degrees of protection.

FIG. 7 illustrates now a SWAT team or the like will approach or withdraw from a target or a threat using an assembly similar to that shown in FIGS. 5 and 6.

Figure 8:
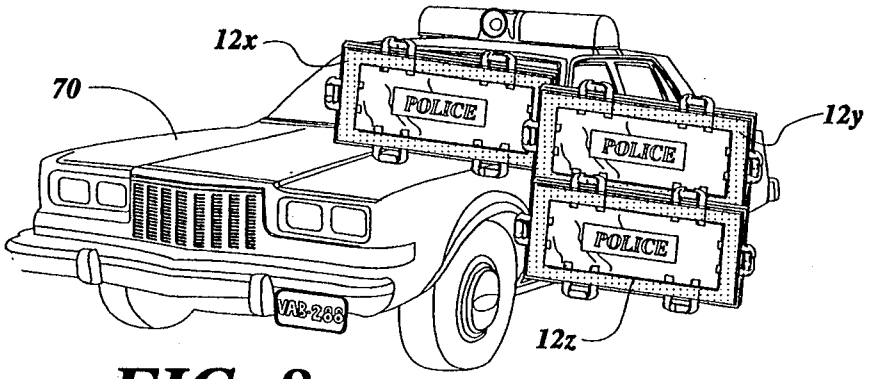
FIG. 8—is a view of a plurality of panels forming a blanket which can be draped over the open door of a police vehicle to provide protection for law enforcement officers.

FIG. 8 is a further illustration of the flexibility of use contributed by the invention described herein. A series of panels **12*x*, 12*y* and 12*z* are assembled as shown and draped over the open door of a vehicle 70. This provides protection to the windshield of the car on the operator's side and provides protection to an officer who is behind the open door. The car can be gradually moved toward the target with the driver protected by the panel 12*x* and the officer walking behind the door by panels 12*y* and 12*z***. The blanket can also be draped over a bush, a bench or other object that is between the officer and the threat.

Figure 9:
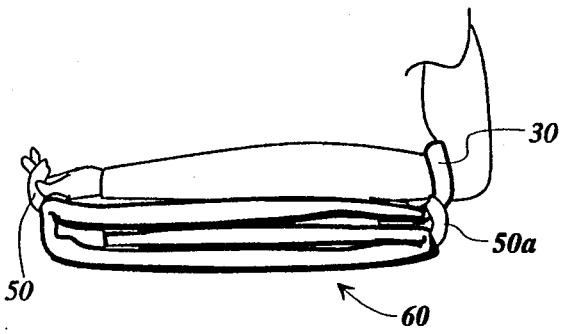
FIG. 9—is a top plan of a panel folded into an arm carried shield.
Figure 10:
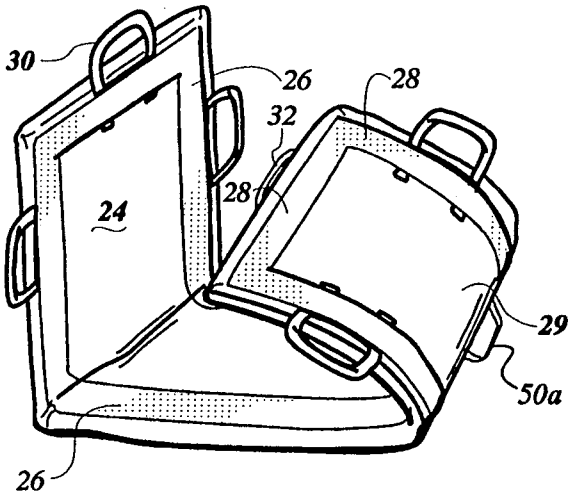
FIG. 10—illustrates perspective views disclosing how the individual panels are folded upon themselves to form the three layered shield of FIG. 9.

The individual panels 12 can be folded into thirds as shown in FIGS. 9 and 10 to provide a shield 60. After folding, the user of the shield can slip an arm through the handle 30 and grab handle **50*a*** with the hand.

Figure 11:
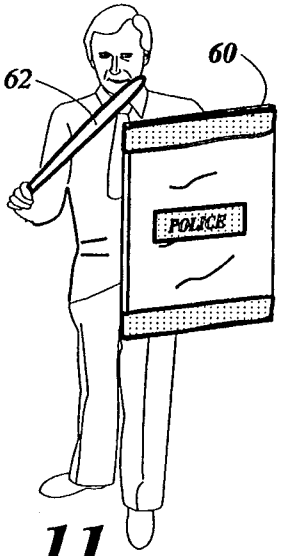
FIG. 11—is a perspective view of a police officer carrying the shield of FIGS. 9 and 10.

Note in FIG. 10 how the loop elements of border 26 on the front panel 24 will engage the hook portion of the border 28 of the reverse side 29 so that the shield 60 will retain its folded position. Such a folded assembly can be efficiently used as a shield for a policeman as seen in FIG. 11. Folded in this fashion, the shield 60 will have over one hundred plies of SPECTRA material and will be very resistant to projectiles of high caliber and speed. As also can be seen in FIG. 11, the shield permits one hand to be free to carry a stick or gun 62.

Figure 12:
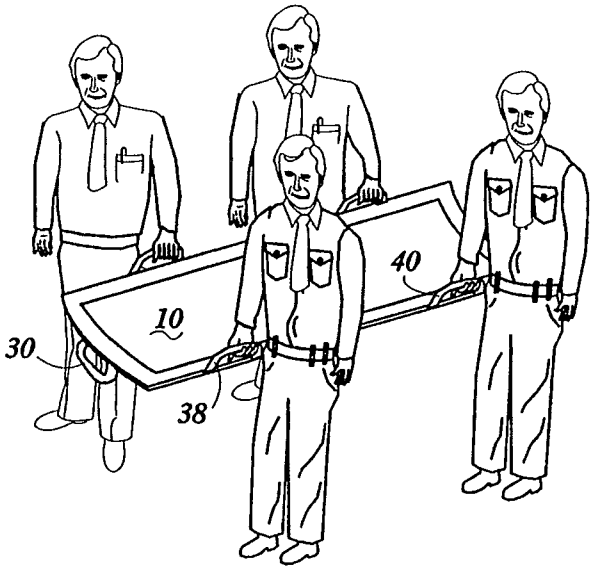
FIG. 12—is a perspective view showing how a panel can be used as a litter.

In the environment in which the invention is oftentimes used, accidents occur. When serious wounds occur the unit can be used as a litter as seen in FIG. 12. The four lateral handles enhance that purpose.

As can be seen, the ballistic protective panels described herein can be combined in a variety of useful blanket configurations of almost unlimited design. This results in a flexibility of use heretofore not achieved in the projectile protective arts.

The embodiment disclosed is the invention as presently contemplated. However, the reader should understand that various changes and modifications can be made without departing from the spirit of the present invention as described in the claims.

We claim:

1. A ballistic-resistant blanket comprising:

a rectangular ballistic envelope of a heavy duty fabric having first and second outer planar surfaces circumscribed by first and second longitudinal sides and first and second lateral sides defining a first peripheral border on said first outer planar surface and a second peripheral border on said second outer planar surface and said envelope defining a pocket;

a ballistic-resistant insert snugly received within said pocket of said envelope;

a first element of a hook-and-loop fastening system about said first peripheral border of said first outer planar surface; and a second element of a hook-and-loop fastening system about the peripheral border of said second outer planar surface, at least one handle secured to each of said first and second longitudinal sides and at least one handle to each of said first and second lateral sides; and at least one further handle secured to said first outer planar surface approximately mid-way between said longitudinal sides and adjacent to, but spaced from, one of said lateral sides.

2. The ballistic blanket of claim 1 wherein one element of a hook and loop fastening system is secured near the middle of said first outer planar envelope surface to receive an insignia tab having the second element of said hook and loop fastening system on one surface thereof.

3. The blanket of claim 2 wherein said blanket is foldable along its longitudinal length into a first end section, a mid-section, and a third end section each of said sections having approximately equal dimensions, such that when said first end section is folded parallel to said mid-section and in contact therewith and said second end section is folded over said first end section, said hook and loop elements will inter-engage forming a three sectioned shield.

4. A ballistic-resistant unit comprising:

a generally planar envelope having first and second outer planar surfaces defining a pocket therebetween, a ballistic-resistant insert package received by said pocket, said first planar surface having a first element of a hook and loop fastening means on to said first planar surface thereof and second element of a hook and loop fastening means on the second planar surface thereof, a second generally planar envelope having a first element of a hook and loop fastening means on a first planar surface thereof and the second element of a hook and loop fastening means on the second planar surface thereof whereby said second envelope can be secured to said first envelope by engaging one of said hook elements to one of said loop elements to provide a blanket of approximately the size of said first and second members combined.

5. The ballistic unit of claim 4 having one or more additional ballistic envelopes of the same configuration as said first and second members whereby an aggregation of said members can be secured together.

6. The ballistic unit of claim 4 wherein said first and second ballistic envelopes are rectangular and said first element of said hook and loop fastening means is secured to the periphery of said first outer planar surface and the second element of said hook and loop fastening means is secured to the periphery of the second outer planar surface thereof.

7. The ballistic unit of claim 4 wherein at least one handle is secured to at least one longitudinal side of each of said envelope.

8. The ballistic unit of claim 4 wherein at least one handle is secured to each of said longitudinal sides of said envelope.

9. The ballistic unit of claim 7 wherein a handle is secured to a planar side of said envelope.

10. The invention of claim 7 wherein first element of a loop and hook fastening means is secured at the approximate center of one said first planar side for reception of a tab having a message on one side thereof and the other element of said hook and loop fastening means on the reverse side thereof.

11. A ballistic blanket having an inner surface and an outer surface and having a first sheet of material having a first inner surface and a first outer surface having a first peripheral edge, a second sheet of material having a second outer surface and a second inner surface and said outer surface having a second peripheral edge, means securing said first and second peripheral edges together and defining a pocket between said inner surfaces, a ballistic-resistant insert package received in said pocket, said outer surface of said first sheet having a first border inwardly of said first peripheral edge, said outer surface of said second sheet having a second border inwardly of said second peripheral edge, a hook portion of a hook and loop fastener secured to said first border, a loop portion of a hook and loop fastener secured to said second border, a plurality of handles secured to said peripheral edge and a middle handle secured to first sheet at a location spaced from the peripheral edge thereof.

12. The ballistic blanket of claim 11 wherein a second middle handle is secured to said first sheet spaced from said first middle handle.

13. The ballistic blanket of claim 11 wherein said insert package includes a plurality of inserts, the outer two of which are a fabric of woven high molecular weight polyethylene fibers and the interior inserts of which are comprised of a plurality of layers of said fabric bonded together with a rigid resin having said fabric sandwiched between said layers.

14. The ballistic blanket of claim 13 wherein said outer two inserts are quilted by a high modular weight polyethylene fiber thread.

15. The invention of claim 11 further including another ballistic blanket as defined in claim 11 wherein means secure said blankets together about their respective peripheries.

* * * * *